US009629510B1

(12) United States Patent
Willhoyt

(10) Patent No.: US 9,629,510 B1
(45) Date of Patent: Apr. 25, 2017

(54) COMPUTER KEYBOARD DUST VACUUM

(71) Applicant: James Willhoyt, Reno, NV (US)

(72) Inventor: James Willhoyt, Reno, NV (US)

( * ) Notice: Subject to any disclaimer, the term of this patent is extended or adjusted under 35 U.S.C. 154(b) by 361 days.

(21) Appl. No.: 14/474,917

(22) Filed: Sep. 2, 2014

(51) Int. Cl.
*A47L 9/02* (2006.01)
*A47L 9/24* (2006.01)

(52) U.S. Cl.
CPC ..... *A47L 9/02* (2013.01); *A47L 9/248* (2013.01)

(58) Field of Classification Search
CPC ..... A47L 9/242; A47L 9/02; A47L 9/248
See application file for complete search history.

(56) References Cited

U.S. PATENT DOCUMENTS

| | | | | |
|---|---|---|---|---|
| 2,866,221 | A | 12/1958 | Inkeri | |
| 4,204,328 | A | 5/1980 | Kutner | |
| 5,050,266 | A * | 9/1991 | Schneider | A47L 9/0072 15/330 |
| 5,123,142 | A | 6/1992 | Miller | |
| D360,502 | S * | 7/1995 | Hollinger | D32/18 |
| 6,044,521 | A * | 4/2000 | Sebek | A47L 9/02 15/393 |
| 6,370,731 | B1 | 4/2002 | Carter | |
| 7,779,860 | B2 * | 8/2010 | Pears | A47L 9/0072 137/556 |
| 8,161,600 | B2 | 4/2012 | Kwon | |
| 8,387,208 | B2 | 3/2013 | Davis | |
| 9,370,287 | B2 * | 6/2016 | Welchert | A47L 9/248 |
| 2004/0098829 | A1 | 5/2004 | Song | |
| 2007/0033766 | A1 | 2/2007 | Livingston | |

FOREIGN PATENT DOCUMENTS

| | | |
|---|---|---|
| JP | 2001224536 | 8/2001 |

* cited by examiner

*Primary Examiner* — Robert Scruggs

(57) ABSTRACT

The computer keyboard dust vacuum is a vacuum cleaner attachment that sucks dust and debris out from under the keys of a computer keyboard. The computer keyboard dust vacuum includes a main tube, outer sleeve, end cap, and protective screen. The hose of a vacuum cleaner is configured to be inserted in the second end of the main tube to provide suction. The end cap, which is mounted on the first end of the main tube, has holes formed in it that allow the suction from the vacuum cleaner to draw dirt and debris away from the keyboard, through the holes in the end cap towards the vacuum cleaner. The main tube and outer sleeve combine to allow the user to vary the amount of suction provided by the vacuum cleaner to the end cap.

3 Claims, 5 Drawing Sheets

COMPUTER KEYBOARD DUST VACUUM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of vacuum accessories, more specifically, a vacuum accessory that is able to extract dust from in and around a keyboard.

SUMMARY OF THE INVENTION

The computer keyboard dust vacuum is a vacuum cleaner attachment that sucks dust and debris out from under the keys of a computer keyboard. An embodiment of the disclosure meets the needs presented above by generally comprising a main tube, outer sleeve, end cap, and protective screen. The hose of a vacuum cleaner is configured to be inserted in the second end of the main tube to provide suction. The end cap, which is mounted on the first end of the main tube, has holes formed in it that allow the suction from the vacuum cleaner to draw dirt and debris away from the keyboard, through the holes in the end cap combine to allow the user to vary the amount of suction provided by the vacuum cleaner to the end cap. The protective screen is placed in the interior of the main tube to trap debris that might be large enough to damage the vacuum cleaner.

These together with additional objects, features and advantages of the computer keyboard dust vacuum will be readily apparent to those of ordinary skill in the art upon reading the following detailed description of presently preferred, but nonetheless illustrative, embodiments of the computer keyboard dust vacuum when taken in conjunction with the accompanying drawings.

In this respect, before explaining the current embodiments of the computer keyboard dust vacuum in detail, it is to be understood that the computer keyboard dust vacuum is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the computer keyboard dust vacuum.

It is therefore important that the claims be regarded as including such equivalent construction insofar as they do not depart from the spirit and scope of the computer keyboard dust vacuum. It is also to be understood that the phraseology and terminology employed herein are for purposes of description and should not be regarded as limiting.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 4:
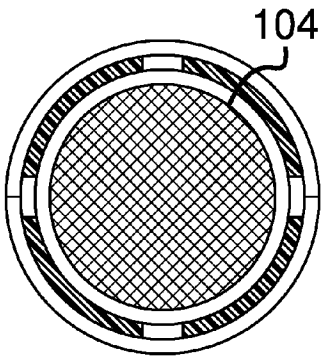
FIG. 4 is a cross-sectional view along line 4-4 in FIG. 1.
Figure 5:
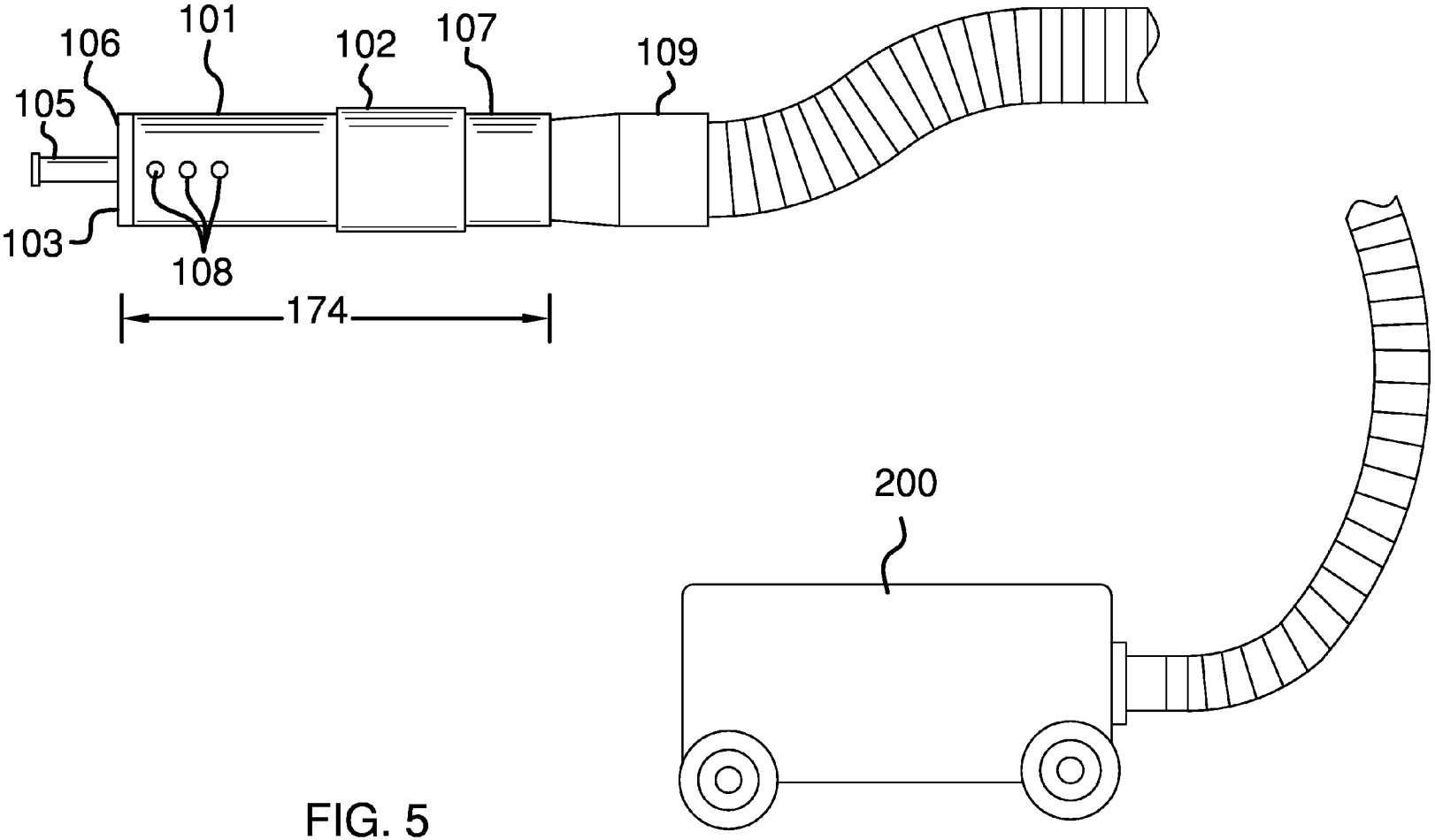
FIG. 5 is a side view of an embodiment in use.

As best illustrated in FIGS. 1 through 7, the computer keyboard dust vacuum 100 (hereinafter invention) generally comprises a main tube 101, an outer sleeve 102, an end cap 103, and a protective screen 104. As shown in FIG. 5, the invention 100 is configured to connect to a vacuum cleaner hose 109, which is connected to a vacuum cleaner 200 that provides suction used via the invention 100.

The end cap 103 is formed with a plurality of peripheral holes 110 and a center hole 111 that allow for the suction to draw air 300 into the main tube 101. The end cap 103 may optionally be configured to hold keyboard keys 400 in place while the suction draws air as well as dust and debris away from a keyboard 401 (see FIG. 7). In use, the end cap 103 is slid across the keyboard keys 400 of the keyboard 400.

Figure 6:
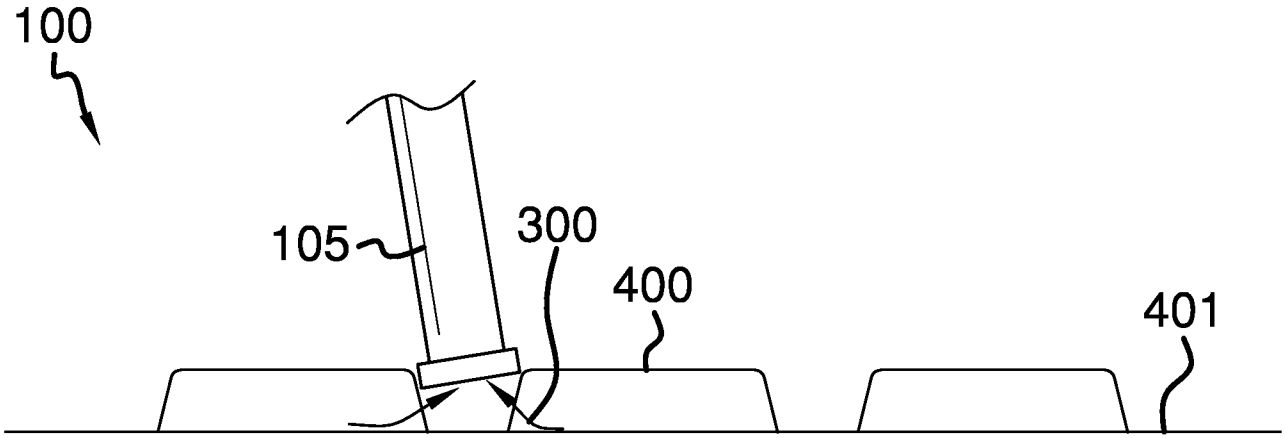
FIG. 6 is a detail view of an embodiment in use.
Figure 7:
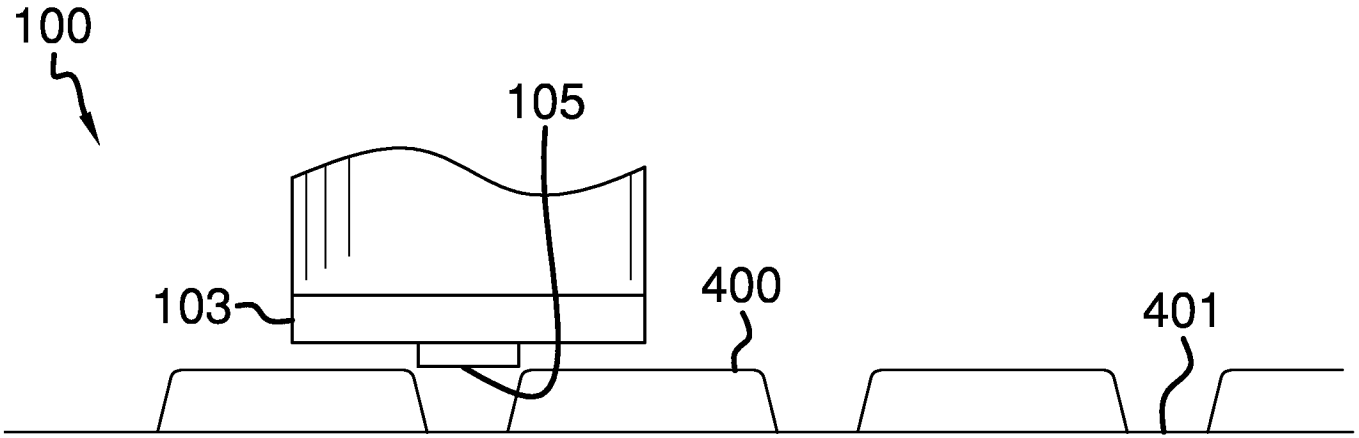
FIG. 7 is another detail view of an embodiment in use.

A third hose 105 can be extended through the center hole 111 in the end cap 103 to allow for cleaning of small or hard to reach areas (see FIG. 6). The end cap 103 is attached to the main tube 101 at a first end 119 of the main tube 101. A second end 118 of the main tube 107 is adapted to be attached to the vacuum cleaner 200.

The main tube 101 includes a plurality of tube holes 108. The figures depict a total of twelve of the tube holes 108. Moreover, the tube holes 108 are formed through the wall of the main tube 101. The outer sleeve 102 is able to slide over the tube holes 108, and controls the suction available to the end cap 103. The more tube holes 108 covered by the outer sleeve 102 the greater the suction available for dust and debris extraction.

Figure 3:
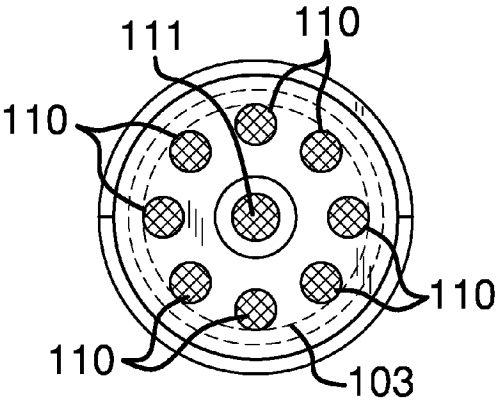
FIG. 3 is a front view of an embodiment of the disclosure.

As shown in FIG. 3, the end cap 103 has formed into it 9 holes. The first eight holes of the nine total holes are referred to as the peripheral holes 110. The peripheral holes 110 are spaced evenly around the center hole 111. The center hole 111 is centered on the end cap 103. The peripheral holes 110 are spaced at 45 degree intervals along a circumference 117. The circumference 117 is consistent between both the end cap 103 as well as the main tube 101. The end cap 103 also has one hole drilled in the center of the end cap 103, referred to as the center hole 111, through which the hose 105 is fitted. The peripheral holes 110 may be ¼" in diameter. The center hole 111 may be ⅜" in diameter.

Figure 1:
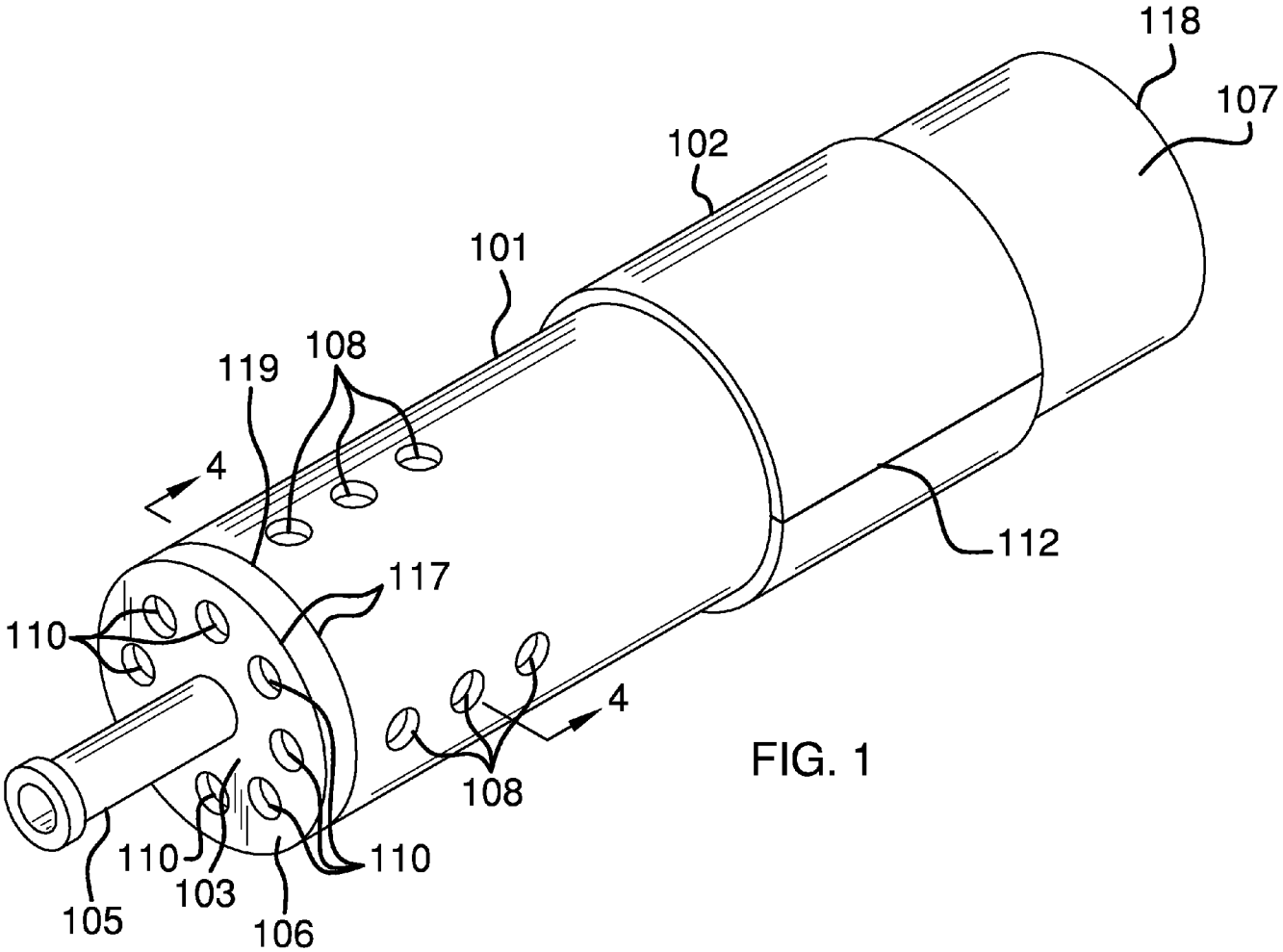
FIG. 1 is a perspective view of an embodiment of the disclosure.
Figure 2:
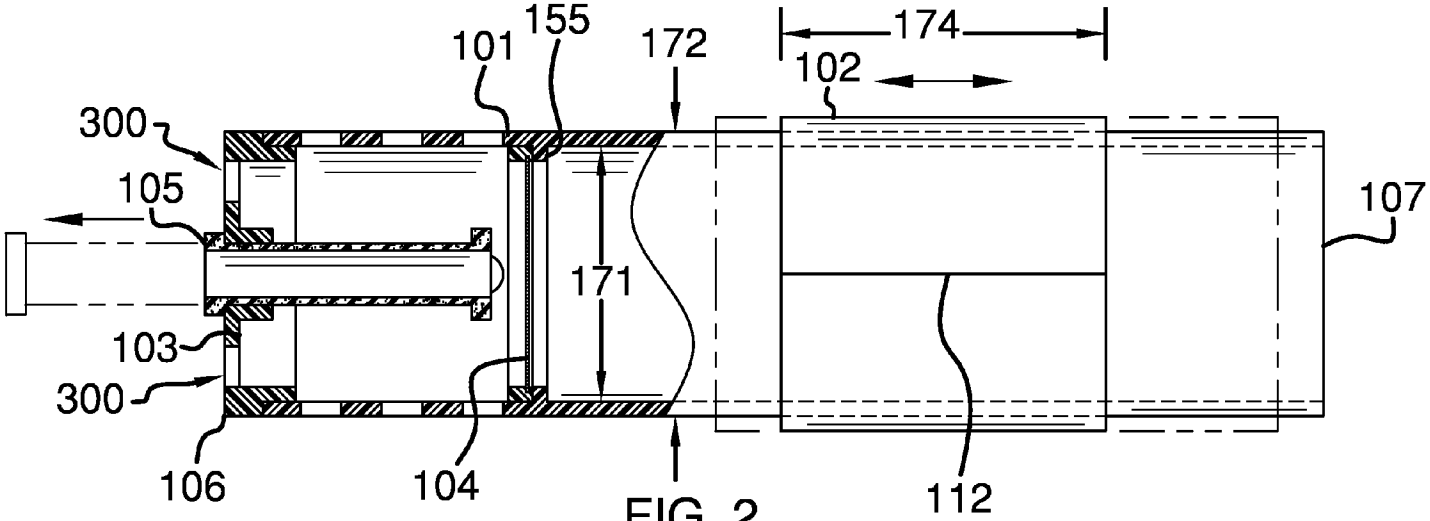
FIG. 2 is a side view of an embodiment of the disclosure.

As shown in FIGS. 1, 2, and 5, the main tube 101 is made of a hollowed pipe having an inner diameter 171, an outer diameter 172, the circumference 117, and a length 173. As shown in FIG. 1, the tube holes 108 are divided into four sets of 3 tube holes 108 that are spaced evenly around the circumference 117 of the main tube 101 (90 degree spacing). The 3 tube holes 108 within an individual set are linearly aligned. The tube holes 108 may be ¼" in diameter and may be placed ½" apart (center to center). The outer sleeve 102 is a sleeve constructed of a hollowed second pipe having an inner diameter corresponsive with the outer diameter 172 of the main tube, and a second length 174. The inner diameter of the outer sleeve 102 is larger than the outer diameter of the main tube 101. The second length 174 of the outer sleeve 102 is less than the length 173 of the main tube 101. The outer sleeve 102 has a slit 112 along the second length 174. This slit 112 allows the outer sleeve 102 to fit easily over the main tube 101 and to facilitate the ease of movement of the outer sleeve 102 along the length of the main tube 101.

As shown in FIGS. 2 and 4, the protective screen 104 is mounted inside the main tube 101 to prevent debris from entering and damaging the vacuum cleaner. The protective screen 104 can be mounted in a frame that is mounted or glued in the main tube 101. Alternatively, the protective screen 104 itself can be mounted or glued directly inside the main tube 101.

FIG. 2 also shows how the third hose 105 extends and retracts through the center hole 111 of the end cap 103. When not in use, the hose 105 is fed through the center hole 111 into the main tube 101.

To use the invention 100, the vacuum cleaner hose 109 is inserted into the second end 118 of the main tube 107. The outer sleeve 102 is positioned over the tube holes 108 to set a desired suction force. The end cap 103 is adapted to be placed perpendicular to the keyboard keys 400 of the keyboard 401 and is slid across the keyboard 401 while the suction of the air 300 towards the vacuum cleaner 200 brings with it dirt and debris trapped in the keyboard 401.

The components of the invention may be made as follows: The main tube 101, outer sleeve 102, and end cap 103 may be made of: 1) molded plastic; or, 2) standard PVC pipes and PVC pipe accessories including, but not limited to, caps, plugs, bushings and reducers.

Referring to FIG. 2, located inside of the main tube 101 is a protective screen 104. The protective screen 104 is secured to a channel 155 located inside of the main tube 101. Moreover, the channel 155 is located downstream of the tube holes 108. The protective screen 104 can be made of any commercially available wire mesh screen material.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A computer keyboard dust vacuum comprising:

a main tube having an outer sleeve slidably engaged thereon;

wherein an end cap is secured to said main tube;

the main tube is configured to be secured onto a vacuum cleaner hose of a vacuum cleaner such that suctioned air is provided to the main tube;

the end cap is configured to be used to extract dust and debris from in and around keyboard keys of a keyboard;

wherein the end cap is formed with a plurality of peripheral holes and a center hole that allow for the suction to draw air into the main tube;

wherein the end cap is optionally configured to hold keyboard keys in place while the suction draws air as well as dust and debris away from the keyboard; wherein a third hose is extended through the center hole in the end cap to allow for vacuuming; wherein the third hose extends and retracts through the center hole of the end cap;

wherein the end cap is attached to the main tube at a first end of the main tube;

wherein a second end of the main tube is adapted to be attached to the vacuum cleaner;

wherein the main tube includes a plurality of tube holes thereon;

wherein the tube holes are formed through the wall of the main tube; wherein the outer sleeve is able to slide over the tube holes, and regulates the level of suction available to the end cap;

wherein the peripheral holes are spaced evenly around the center hole;

wherein the center hole is centered on the end cap;

wherein the peripheral holes are spaced at 45 degree intervals along a circumference; wherein the circumference is consistent between both the end cap as well as the main tube;

wherein the end cap also has one hole drilled in the center of the end cap, which is the center hole, through which the hose is slideably engaged;

wherein the main tube is made of a hollowed pipe having an inner diameter, an outer diameter, the circumference, and a length; wherein the tube holes are divided into four sets of 3 tube holes that are spaced evenly around the circumference of the main tube;

wherein each of the four sets of the 3 tube holes are linearly aligned;

wherein the outer sleeve is a hollowed second pipe having an inner diameter corresponsive with the outer diameter of the main tube, and a second length; wherein the inner diameter of the outer sleeve is larger than the outer diameter of the main tube; wherein the second length of the outer sleeve is less than the length of the main tube; wherein the outer sleeve has a slit along the second length; wherein the slit allows the outer sleeve to fit over the main tube and to facilitate the movement of the outer sleeve along the length of the main tube;

wherein a protective screen is mounted inside the main tube to prevent debris from entering and damaging the vacuum cleaner.

2. A computer keyboard dust vacuum comprising:

a main tube having an outer sleeve slidably engaged thereon;

wherein an end cap is secured to said main tube;

the main tube is configured to be secured onto a vacuum cleaner hose of a vacuum cleaner such that suctioned air is provided to the main tube;

the end cap is configured to be used to extract dust and debris from in and around keyboard keys of a keyboard;

wherein the end cap is formed with a plurality of peripheral holes and a center hole that allow for the suction to draw air into the main tube;

wherein the end cap is optionally configured to hold keyboard keys in place while the suction draws air as well as dust and debris away from the keyboard;

wherein a third hose is extended through the center hole in the end cap to allow for vacuuming; wherein the third hose extends and retracts through the center hole of the end cap;

wherein the end cap is attached to the main tube at a first end of the main tube;

wherein a second end of the main tube is adapted to be attached to the vacuum cleaner;

wherein the main tube includes a plurality of tube holes thereon;

wherein the tube holes are formed through the wall of the main tube;

wherein the outer sleeve is able to slide over the tube holes, and regulates the level of suction available to the end cap;

wherein the peripheral holes are spaced evenly around the center hole;

wherein the center hole is centered on the end cap;

wherein the peripheral holes are spaced at 45 degree intervals along a circumference; wherein the circumference is consistent between both the end cap as well as the main tube; wherein the end cap also has one hole drilled in the center of the end cap, which is the center hole, through which the hose is slideably engaged; wherein the main tube is made of a hollowed pipe having an inner diameter, an outer diameter, the circumference, and a length; wherein the tube holes are divided into four sets of 3 tube holes that are spaced evenly around the circumference of the main tube; wherein each of the four sets of the 3 tube holes is linearly aligned;

wherein the outer sleeve is a hollowed second pipe having an inner diameter corresponsive with the outer diameter of the main tube, and a second length; wherein the inner diameter of the outer sleeve is larger than the outer diameter of the main tube; wherein the second length of the outer sleeve is less than the length of the main tube; wherein the outer sleeve has a slit along the second length; wherein the slit allows the outer sleeve to fit over the main tube and to facilitate the movement of the outer sleeve along the length of the main tube.

3. The computer keyboard dust vacuum according to claim 2 wherein a protective screen is mounted inside the main tube to prevent debris from entering and damaging the vacuum cleaner.

* * * * *